US012258700B2

(12) United States Patent
Frost

(10) Patent No.: US 12,258,700 B2
(45) Date of Patent: Mar. 25, 2025

(54) HEAT EXCHANGE EXHAUST SYSTEM FOR CLOTHES DRYER

(71) Applicant: Doug Frost, Port Alberni (CA)

(72) Inventor: Doug Frost, Port Alberni (CA)

( * ) Notice: Subject to any disclaimer, the term of this patent is extended or adjusted under 35 U.S.C. 154(b) by 643 days.

(21) Appl. No.: 17/398,897

(22) Filed: Aug. 10, 2021

(65) Prior Publication Data

US 2022/0136166 A1 May 5, 2022

Related U.S. Application Data

(60) Provisional application No. 63/063,576, filed on Aug. 10, 2020.

(51) Int. Cl.
*D06F 58/26* (2006.01)
*F24F 12/00* (2006.01)

(52) U.S. Cl.
CPC ..... *D06F 58/26* (2013.01); *F24F 12/006* (2013.01)

(58) Field of Classification Search
CPC ..... D06F 58/26; F24F 12/006
USPC ..... 34/86, 595–610
See application file for complete search history.

(56) References Cited

U.S. PATENT DOCUMENTS 3,892,048 A * 7/1975 Jacobsen, Jr. ..... D06F 58/04 34/604
4,161,214 A * 7/1979 Wendel ..... F28F 1/36 165/172
4,214,380 A * 7/1980 Meyer ..... F24F 13/18 34/235
5,435,377 A * 7/1995 Kratochvil ..... D06F 58/20 165/154
5,560,120 A * 10/1996 Swanson ..... D06F 58/22 55/320
6,785,981 B1 * 9/2004 Harpenau ..... D06F 34/26 34/558
8,240,064 B2 * 8/2012 Steffens ..... D06F 58/22 34/480
8,261,466 B2 * 9/2012 Latack ..... D06F 58/08 34/607
2008/0110041 A1 * 5/2008 Ehlers ..... D06F 58/48 34/513

(Continued)

FOREIGN PATENT DOCUMENTS

CA 3127354 A1 * 2/2022 ..... D06F 58/26
DE 102008054548 A1 * 6/2010 ..... D06F 58/22
EP 2196577 A1 * 6/2010 ..... D06F 58/22

*Primary Examiner* — Stephen M Gravini
(74) *Attorney, Agent, or Firm* — Stephen R. Burri

(57) ABSTRACT

A heat exchange exhaust system for a clothes dryer, comprising an inner exhaust air conduit, an outer air supply conduit concentric with and external to the inner exhaust air conduit; a plurality of radial fins for maintaining a volume between the inner exhaust conduit and the external supply conduit; sealing means for sealing the back perimeter of the clothes dryer to an adjacent wall; and an air supply plenum within the adjacent wall from which the inner exhaust air conduit and outer air supply conduit connect to an external building wall. All incoming supply air may be drawn from the exterior and all exhaust air may be exhausted to the exterior. The supply air and exhaust air are physically separated. Heat energy in the exhaust air is transferred from the outgoing exhaust air to the incoming air supply to preheat the incoming air supply and cool the exhaust air.

7 Claims, 8 Drawing Sheets

(56) References Cited

U.S. PATENT DOCUMENTS

| | | | | |
|---|---|---|---|---|
| 2009/0277034 | A1* | 11/2009 | Wilson | D06F 58/20 34/235 |
| 2022/0136166 | A1* | 5/2022 | Frost | D06F 58/26 34/86 |

* cited by examiner

HEAT EXCHANGE EXHAUST SYSTEM FOR CLOTHES DRYER

FIELD OF THE INVENTION

The present invention relates to air-to-air heat exchangers. In particular, the present invention relates to an air-to-air heat exchange exhaust system for clothes dryers.

BACKGROUND OF THE INVENTION

It is known to provide residential and commercial clothes dryers which draw in conditioned interior air which has been heated, cooled or moisture controlled by the heating, ventilation, and cooling ("HVAC") systems of the building, heat the air in the dryer to effect drying, and then exhaust the heated air to the exterior of the building.

It is estimated that more than 5% of residential electricity consumption is expended to dry laundry in clothes dryers. Some of this energy is used to heat previously cooled ambient air or cold exterior air, while the dryer simultaneously expels heated exhaust air.

It would be desirable to provide a heat exchanger to heat the supply air more efficiently and to recapture heat energy from the exhaust air. The present invention achieves these objectives and will save energy by reducing demands on the HVAC systems of buildings.

BRIEF DESCRIPTION OF THE DRAWINGS

A detailed description of the preferred embodiments is provided below by way of example only and with reference to the following drawings, in which.

Figure 1:
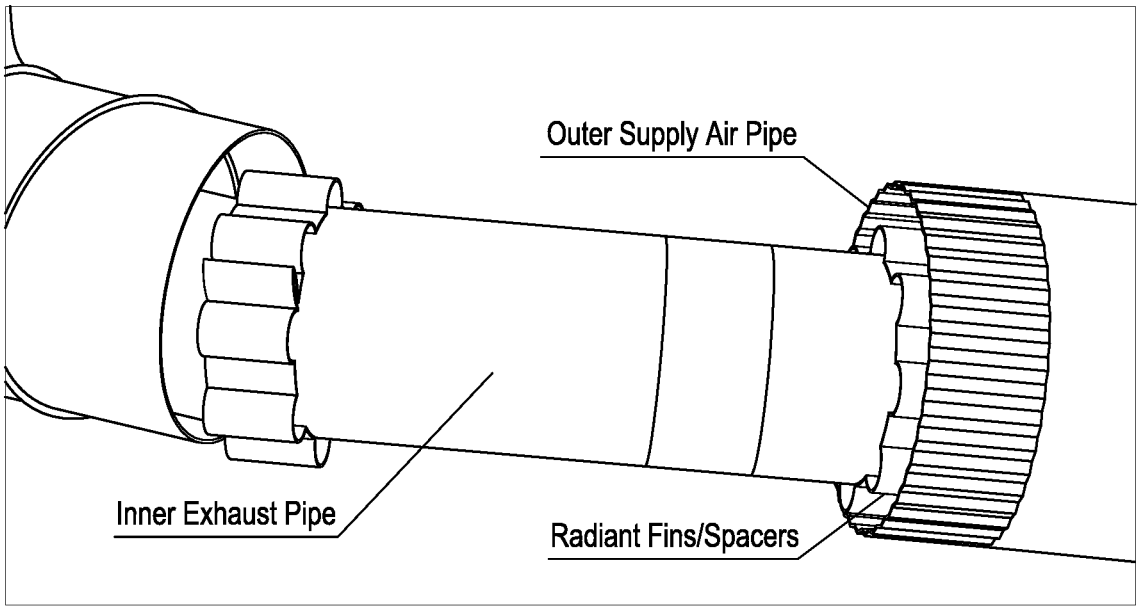
FIG. 1 is a cutaway view of the concentric conduit system of the heat exchange system of the present invention.
Figure 2:
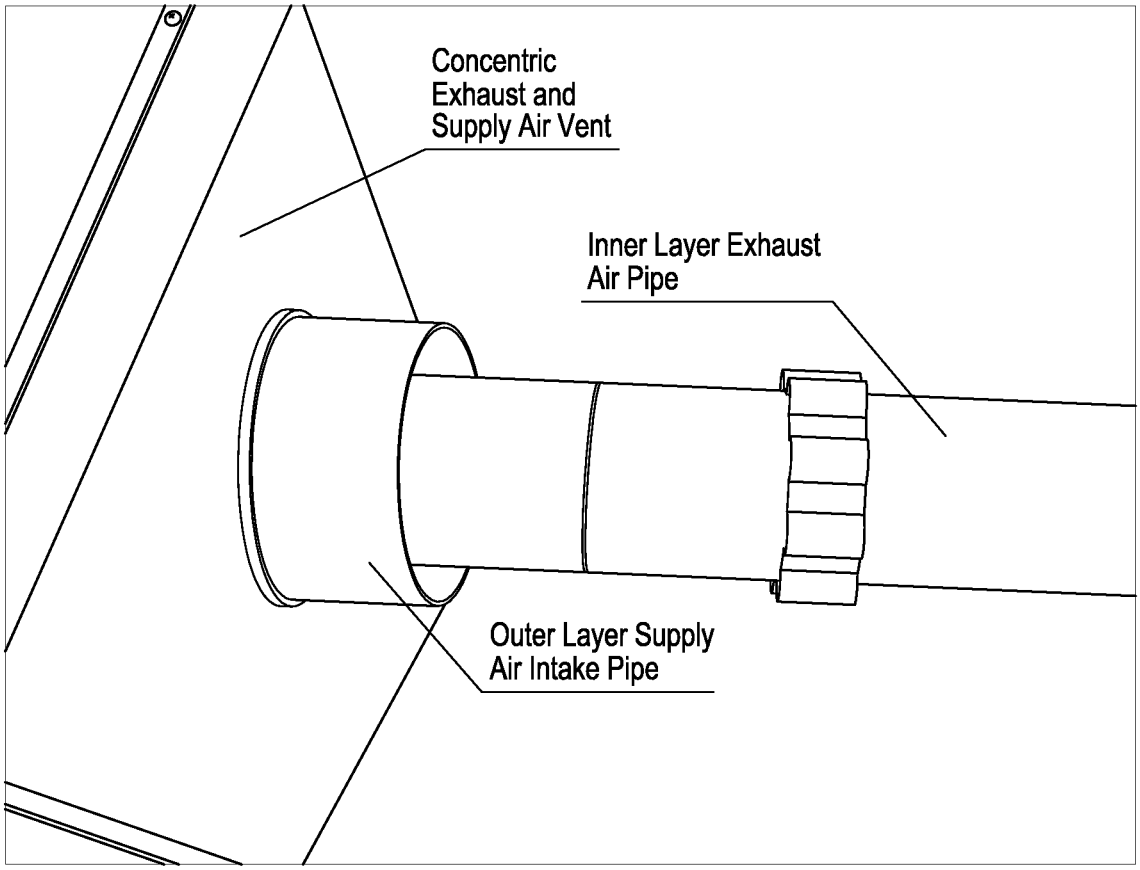
FIG. 2 depicts the vent end of the heat exchange system of the invention.
Figure 3:
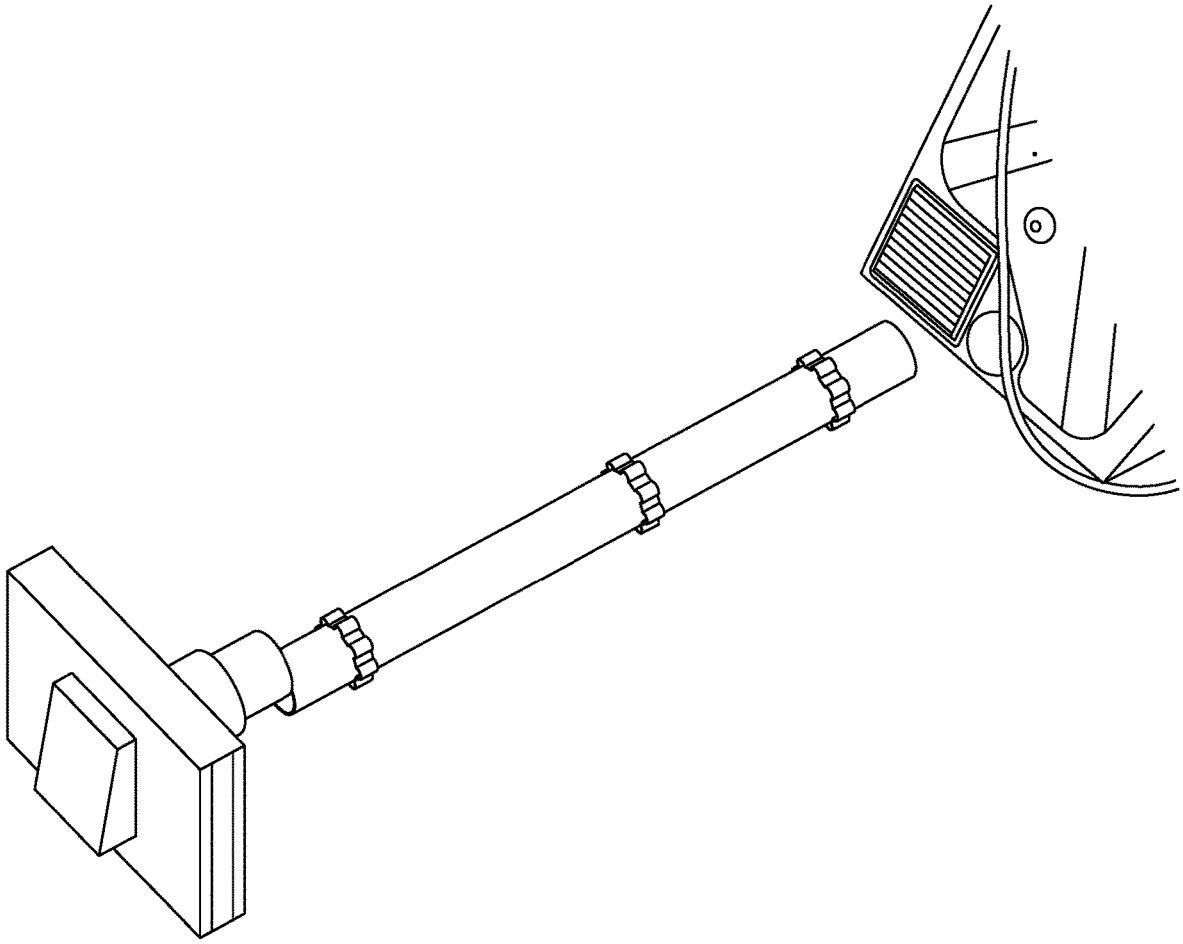
FIG. 3 is a perspective view of the exterior vent and the inner conduit with radial spacers.
Figure 4:
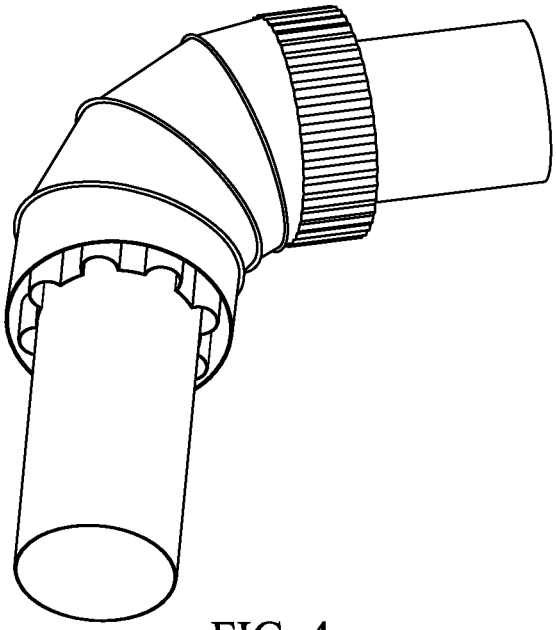
FIG. 4 is a perspective view of an elbow of the conduit system of the heat exchanger of the invention; a FIG. 5 depicts the conduit extending from the exterior vent to the air supply plenum.
Figure 5:
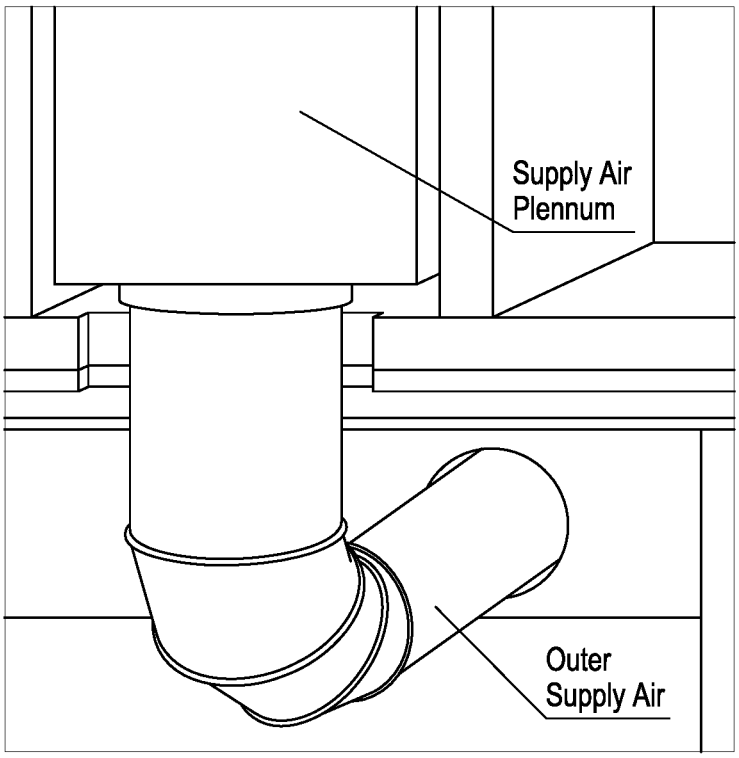
Figure 6:
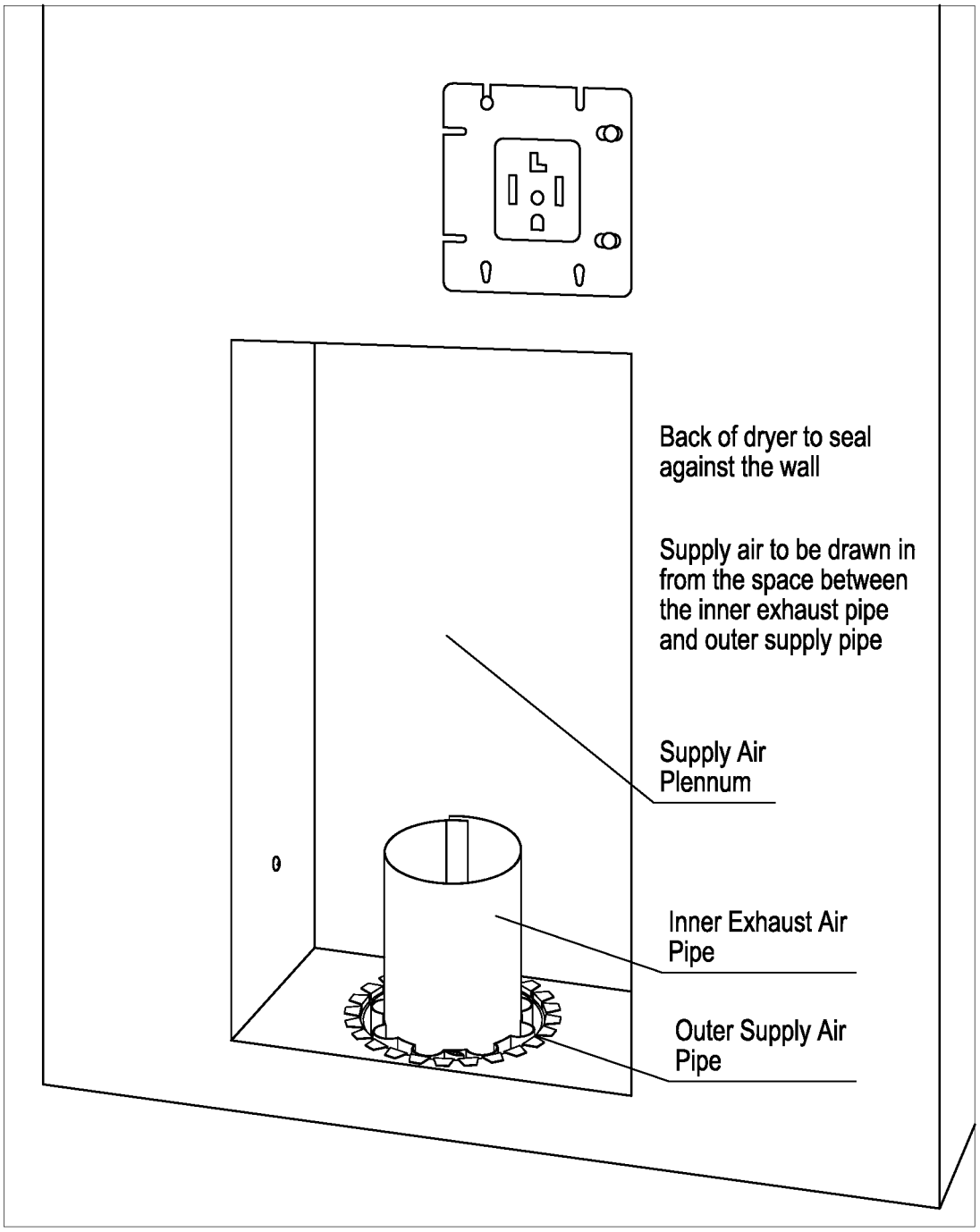
FIG. 6 depicts the air supply plenum of the heat exchanger system.
Figure 7:
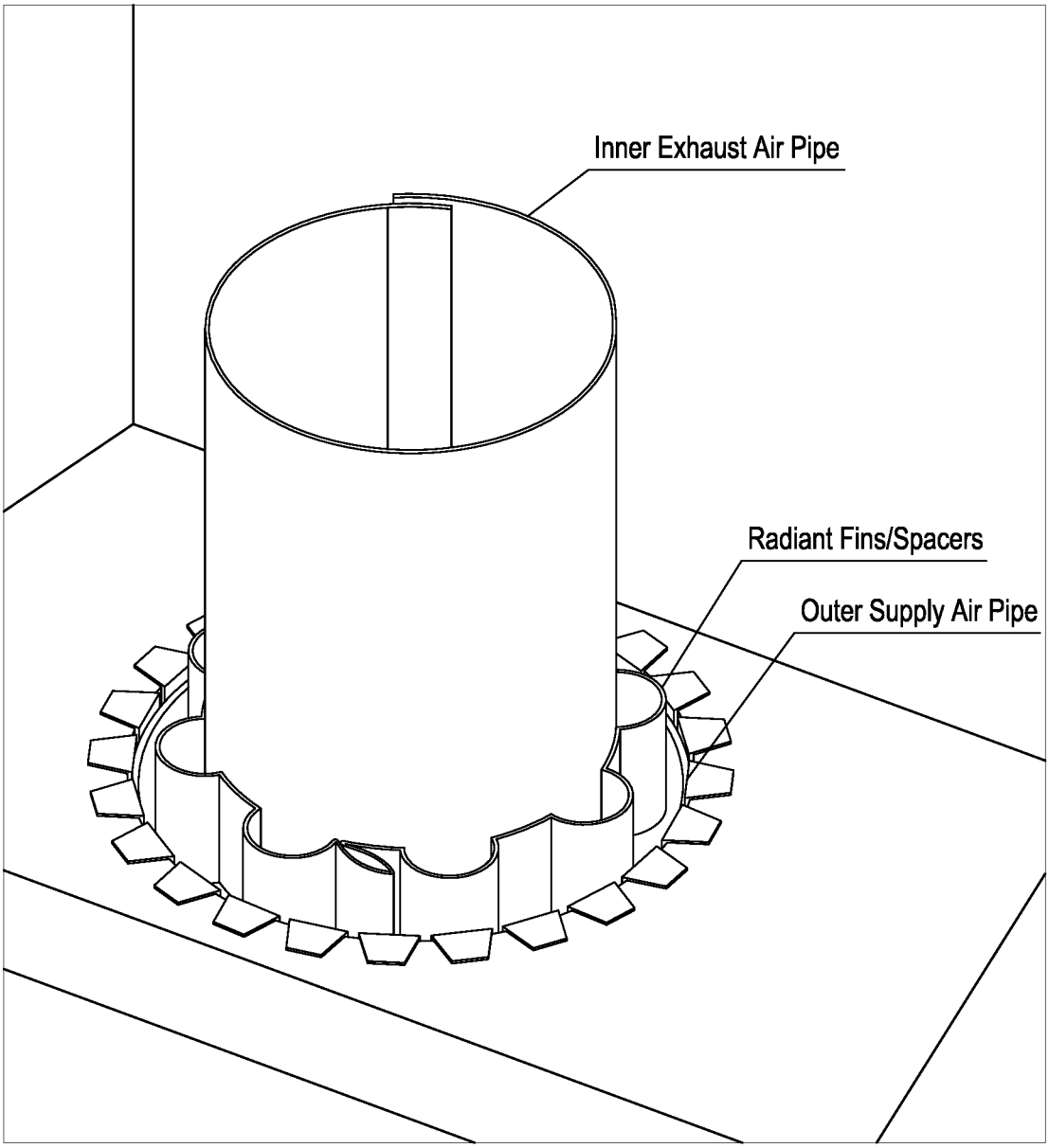
FIG. 7 depicts the connection between the heat exchanger conduit system and the air supply plenum.
Figure 8:
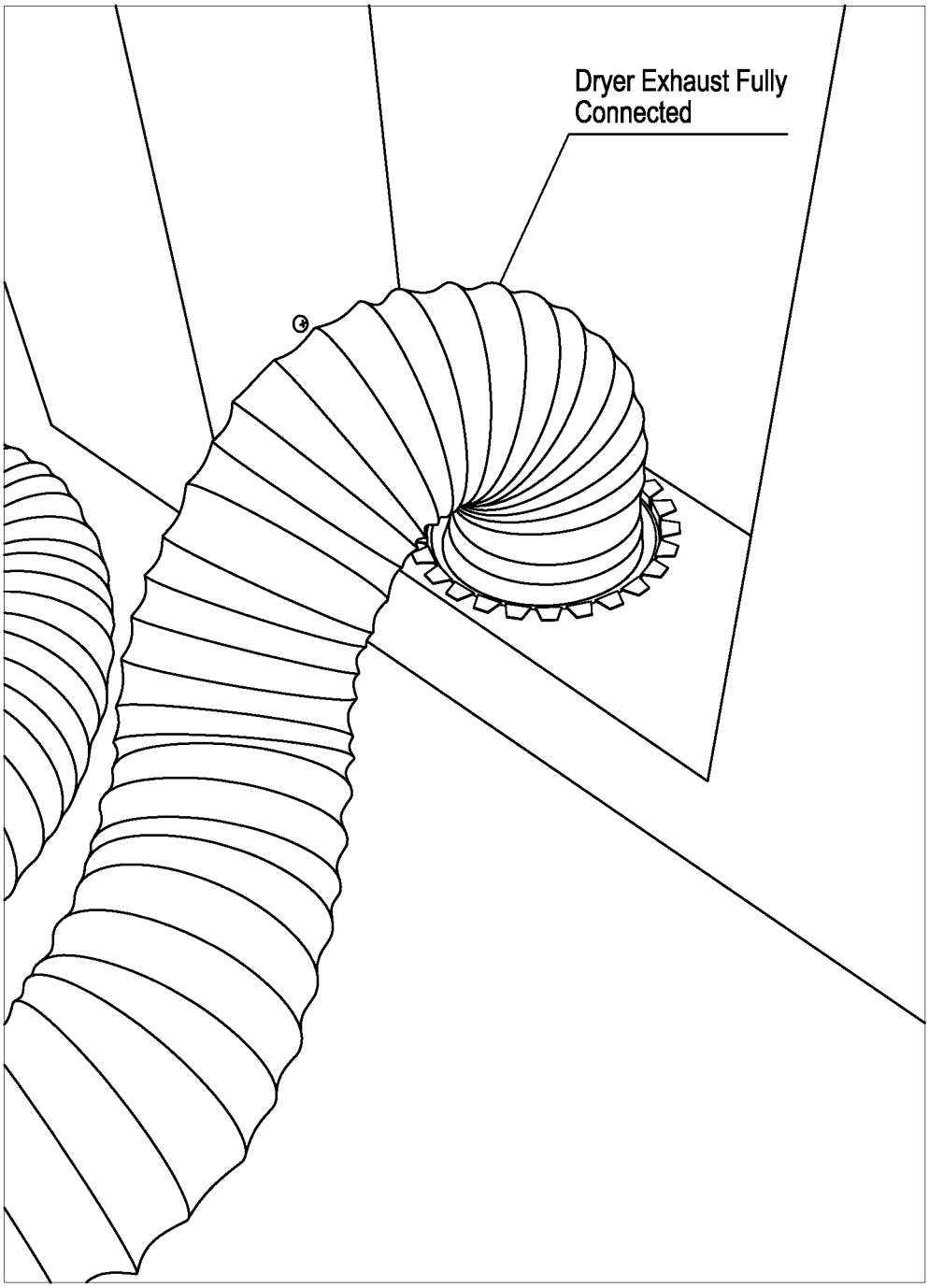
FIG. 8 shows the connection between a standard dryer exhaust pipe and the exhaust conduit of the heat exchanger in the air supply plenum.
Figure 9:
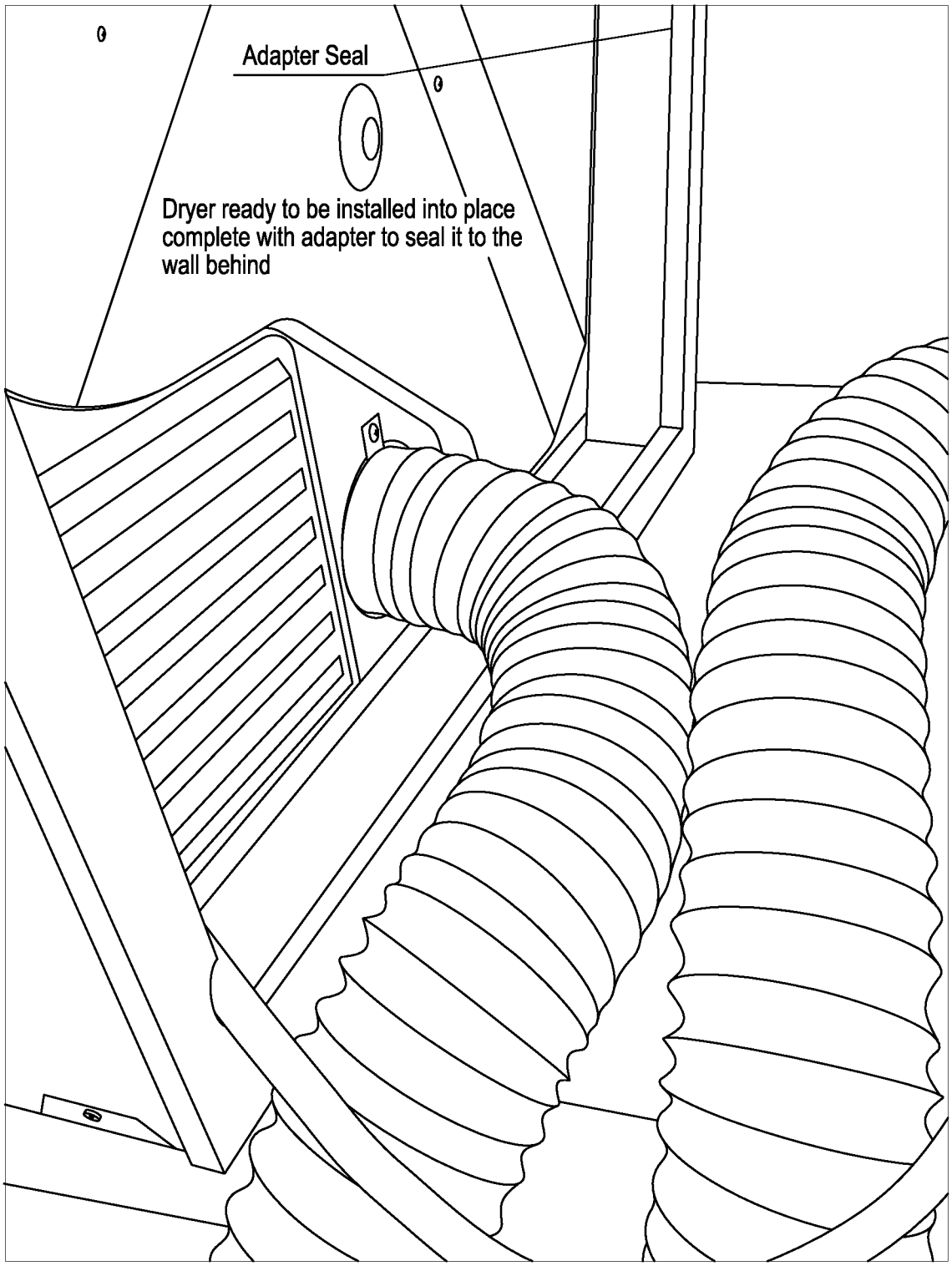
FIG. 9 depicts the rear of the dryer showing dryer air supply intake.
Figure 10:
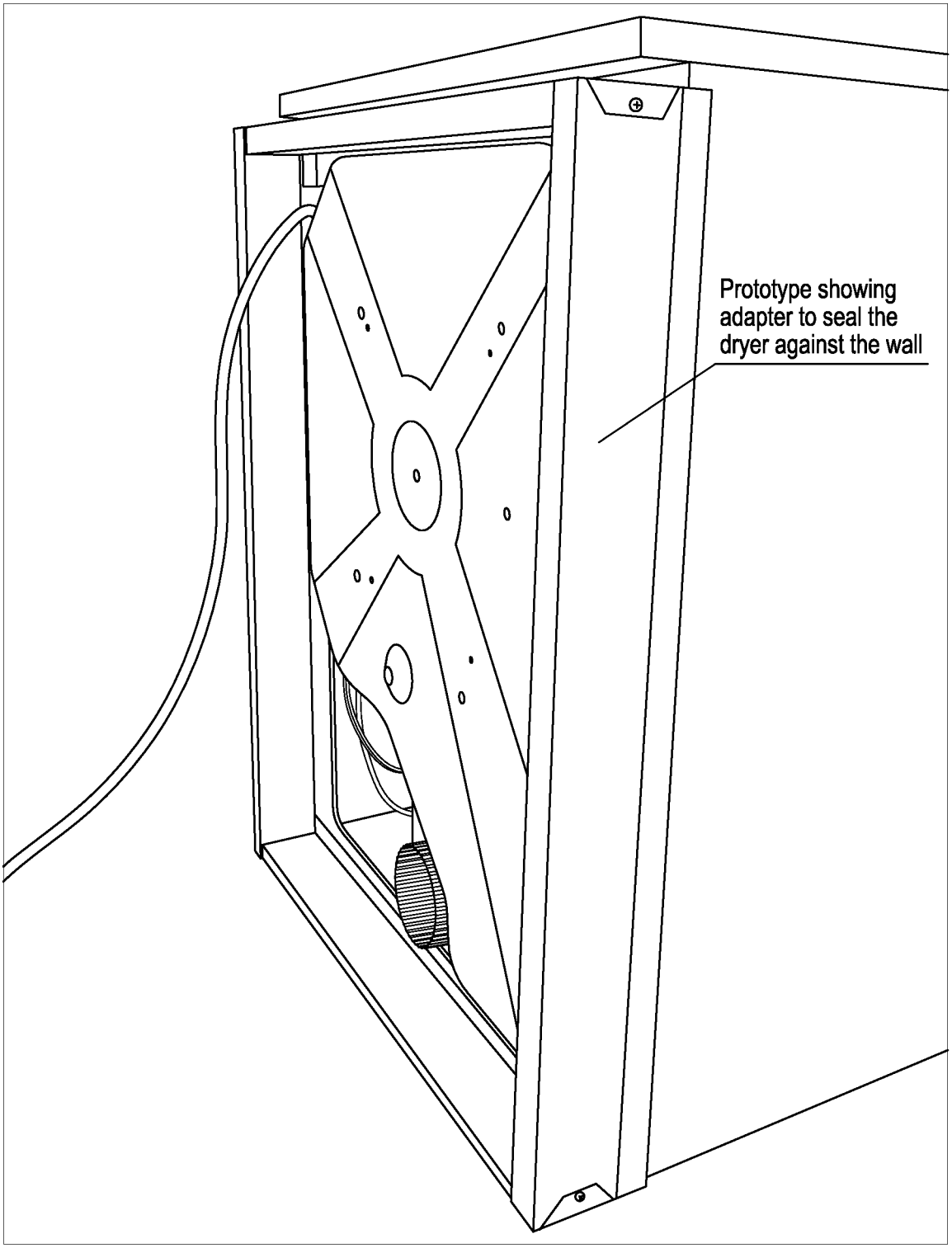
FIG. 10 depicts the adapter and sealing means for attaching the dryer to the adjacent wall.

In the drawings, several embodiments of the invention are illustrated by way of example. It is to be expressly understood that the description and drawings are only for the purpose of illustration and as an aid to understanding and are not intended as a definition of the limits of the invention.

DESCRIPTION OF THE INVENTION

As depicted in the drawings, the present invention comprises a concentric air-to-air heat exchanger system for a clothes dryer.

In this specification, the following terms have the meanings set out herein: Conditioned air is air inside the conditioned space or building envelope which has had the temperature and or the humidity controlled. Unconditioned air is air from the exterior of a building envelop which has had no mechanical conditioning. Supply air is air drawn into the outer layer supply air duct directly from the environment and the exterior of the buildings conditioned space or buildings envelope. Exhaust air is air deliberately removed from the dryer and rejected to the environment. Concentric means having a common center. Air to air heat exchanger is an air-to-air heat exchanger which brings two air streams of different temperatures into thermal contact, transferring heat from the exhausting inside air to the incoming outside air.

This invention consists of an air-to-air heat exchanger and ventilation system in a concentric arrangement which draws the supply air needed for the clothes dryer to operate from the exterior of the building and preheats that incoming supply air by means of an air-to-air thermal energy or heat exchange through conductive, convective, and radiant processes which transfer heat between relatively hotter dryer exhaust air and relatively cooler unconditioned supply air to the dryer. This system eliminates the need for the dryer to pull conditioned air from the interior of the building envelope and may therefore save energy by reducing the thermal energy required to heat the supply air to the required drying temperature. The system provides full physical separation between the warm exhaust air mix and the incoming supply air during the heat exchange or air supply and exhaust processes, as well as full separation from the interior of the building. This separation is essential for avoiding an increase in the demands on the building's HVAC system.

According to a preferred embodiment of the invention, there is provided an electric or gas clothes dryer having a heat exchange exhaust system. The heat exchange exhaust system comprises an inner exhaust air conduit, an outer air supply conduit concentric with and external to the inner exhaust air conduit, a plurality of radial fins or spacers for maintaining a volume between the inner exhaust conduit and the external supply conduit. The dryer further comprises sealing means for sealing the back perimeter of the dryer to an adjacent wall containing an air supply plenum from which the concentric air-to-air heat exchanger extends to an external building wall. The system provides an isolated air supply channel extending from the exterior dryer vent through the outer air supply conduit into the air supply plenum before being drawn into the dryer. The system also provides a separate exhaust air channel extending from the dryer through the dryer exhaust pipe into the inner exhaust conduit of the heat exchanger system before being exhausted through the dryer vent to the exterior.

Preferably, the air-to-air heat exchanger system is in a concentric arrangement which preheats the incoming air supply of the dryer with the outflowing exhaust air of the dryer without mixing of the two air streams. The two air streams will be kept separated by the concentric arrangement of the air-to-air heat exchange conduits. The heat exchanger will consist of an inner core exhaust air pipe and an outer layer air intake supply pipe between which can be radiant fins or structures to aid in heat transfer.

In operation, an external unconditioned air supply is drawn in by the dryer between the outer conduit and inner conduit to the in supply plenum in the wall adjacent the dryer, from which it then supplies the adjacent dryer sealed to the wall surrounding the air supply plenum.

As the heated air of the dryer is exhausted, it passes through the inner exhaust conduit to the external exhaust vent. As the heated exhaust air travels outward through the inner conduit, heat is transferred to the radial spacers or fins and adjacent air spaces between the inner and outer conduits. This heat exchange cools the outgoing exhaust air and heats the incoming supply air. By heating the supply air, less energy is required to bring the supply air to a sufficient temperature for clothes drying operations. In addition, thermal energy from the exhaust air leaving the exhaust vent is recaptured, reducing energy waste.

The inner core exhaust air pipe of the dryer comprises a pipe of sufficient diameter to provide the manufacturer's specified exhaust air output requirements of the dryer and is manufactured of a thermally conductive material such as copper or other metal and may also have radiant fins or structures attached to its outer surface to radiate and transfer heat to the incoming supply air. Incoming supply air runs between the outer layer of the inner core exhaust pipe and the inner layer of the air supply intake pipe and transfers thermal enemy from the exhaust air to the supply air before entering the dryer.

The outer layer air supply air intake pipe consists of a pipe of sufficient diameter to surround and enclose the inner core exhaust pipe and all its radiant fins and structures and is of sufficient size to meet the dryer manufacturer's specified air intake requirements. The supply air intake is fully enclosed and does not mix with the exhausting warm air nor the interior conditioned air of the building at any point daring the thermal transfer process. The outer layer supply air intake pipe draws supply air directly from the exterior of the building envelope, eliminating or reducing the need to draw supply air from the interior conditioned air of the building. During this process supply air will be preheated on its way to the dryer by passing over the outer layer of the exhaust core pipe and its radiant fins or structures which will transfer thermal energy to the dryer supply air before the supply air enters the dryer.

This invention is an improvement on prior art dryer heat recovery technologies because it utilizes a thermal transfer method for the supply air coming from the exterior of the building envelope and does not exhaust any hot air to the interior of a building as prior art systems do. By keeping the two air streams separate the system avoids cross-contamination of lint and moisture into the supply stream. Supply and exhaust air do not mix but are kept separate by the concentric arrangement of the inner exhaust pipe and the outer supply air pipe as two separate air streams on their way to and from the dryer.

A prototype has been constructed and tested. The inner exhaust air pipe used in the testing was 4" in diameter and 10' long with one 90-degree elbow and two 45-degree elbows. The outer supply air pipe used in the testing was 6" in diameter and 10' long with one 90-degree elbow and two 45-degree elbows representing a typical piping installation arrangement for residential dryers though hundreds of piping arrangements using the same concept could be used all yielding similar results. The dryer was sealed to a partial wall at the rear of the dryer, meant to represent a regular wall in a building, by means of an adapter attached to the back of the dryer for covering and enclosing the supply air plenum in the wall cavity behind the dryer so that supply air could only be drawn from the air supply plenum which is id by the supply air intake pipe.

Air flow rate and direction as well as ambient indoor and outdoor temperature and supply air and exhaust air temperatures at the exterior of the building envelope were measured using a Testo 410i Smart Probe Results were shown that air flowing through the 6" outer supply air pipe was flowing towards the dryer and air flowing in the 4" inner exhaust pipe was flowing away from the dryer. Indoor and outdoor ambient air temperature were both measured at 20 degrees Celsius. Supply air entering was 20 degrees Celsius. Exhaust air maximum temperature of 39.9 degrees Celsius was achieved at 5 minutes dryer run time exiting the exhaust air pipe at the exterior of the budding.

Temperature of the supply air immediately prior to entering the dryer was measured using a Fluke 16 Multimeter. Temperature readings of 29 degree Celsius of the supply air in the outer supply air pipe before entering the supply air plenum behind the dryer were recorded.

The system of thermal transfer by supplying air from the exterior of a building directly to a clothes dryer while exhausting in a concentric arrangement connected directly to the same clothes dryer while also achieving thermal transfer from one air stream to another and keeping those streams separate to avoid cross contamination of lint or moisture in the process and not drawing supply air from the conditioned space of a building was achieved.

The prototype testing achieved a heat exchange system of two separate air streams in an air-to-air heat exchanger drawing unconditioned supply air through the outer 6" supply air pipe from the exterior of the building envelope and exhausting dryer air through the inner 4" exhaust air pipe which resulted in the incoming supply air to be thermally conditioned through conductive, convective, and or radiant processes before entering the clothes dryer.

It will be appreciated by those skilled in the art that other variations of the preferred embodiment may also be practised without departing from the scope a the invention.

The invention claimed is:

1. A heat exchange exhaust system for a clothes dryer, the heat exchange exhaust system comprising:

a. an inner exhaust air conduit connected to a dryer exhaust vent;

b. an outer air supply conduit concentric with and external to the inner exhaust air conduit, wherein the inner exhaust air conduit and the outer air supply conduit are fully physically separated;

c. a plurality of radial fins for maintaining a volume between the inner exhaust air conduit and the outer air supply conduit;

d. an adapter attached to the back of the dryer for sealing a back perimeter of the clothes dryer to an adjacent wall;

e. an air supply plenum within the adjacent wall from which the inner exhaust air conduit and outer air supply conduit connect to an external building wall.

2. The heat exchange exhaust system of claim 1, wherein the inner exhaust air conduit has a diameter of at least 4 inches.

3. The heat exchange exhaust system of claim 1, wherein the outer air supply conduit has a diameter of at least 6 inches.

4. The heat exchange exhaust system of claim 1, wherein the inner exhaust air conduit is housed within the outer air supply conduit.

5. The heat exchange exhaust system of claim 4, further comprising a plurality of radial fins disposed between the inner exhaust air conduit and the outer incoming supply air conduit for maintaining a volume between the inner exhaust air conduit and the outer air supply conduit.

6. The heat exchange exhaust system of claim 1, wherein heat energy contained in clothes dryer exhaust air is transferred from outgoing exhaust air to incoming air supply to preheat incoming air supply and cool exhaust air.

7. The heat exchange exhaust system of claim 1, wherein all incoming supply air is drawn from an exterior supply and all exhaust air is exhausted to an exterior location.

* * * * *